United States Patent [19]

Gregoire

[11] 4,456,045

[45] Jun. 26, 1984

[54] DUAL ROTATION CHIPPING HEAD

[76] Inventor: James L. Gregoire, 85 Willowick Dr., Decatur, Ga. 30038

[21] Appl. No.: 457,866

[22] Filed: Jan. 13, 1983

[51] Int. Cl.[3] ..... B27C 9/00

[52] U.S. Cl. ..... 144/373; 144/39; 144/220; 144/378

[58] Field of Search ..... 144/1 R, 3 R, 39, 176, 144/162 R, 220, 218, 373, 369, 378, 223, 222

[56] References Cited

U.S. PATENT DOCUMENTS

| | | | |
|---|---|---|---|
| 3,780,778 | 12/1973 | Chapman | 144/223 |
| 4,147,193 | 5/1979 | Kivimar | 144/220 |
| 4,266,584 | 5/1981 | Lomnicki | 144/220 |

*Primary Examiner*—W. D. Bray
*Attorney, Agent, or Firm*—B. J. Powell

[57] ABSTRACT

A chipping machine for processing wood including a chipping head with circumferentially spaced chipping knives to chip those portions of the wood in interference with the chipping knives as the wood is moved past the inboard end of the chipping head, a facing head rotatably mounted adjacent the inboard end of the chipping head with facing cutters adapted to cut a flat face on the wood just inboard of the chipping knives, and drive means adapted to rotate the chipping head at a speed to generate the desired size wood chips and to rotate the facing head at a speed to generate the desired surface finish on the face of the wood.

20 Claims, 8 Drawing Figures

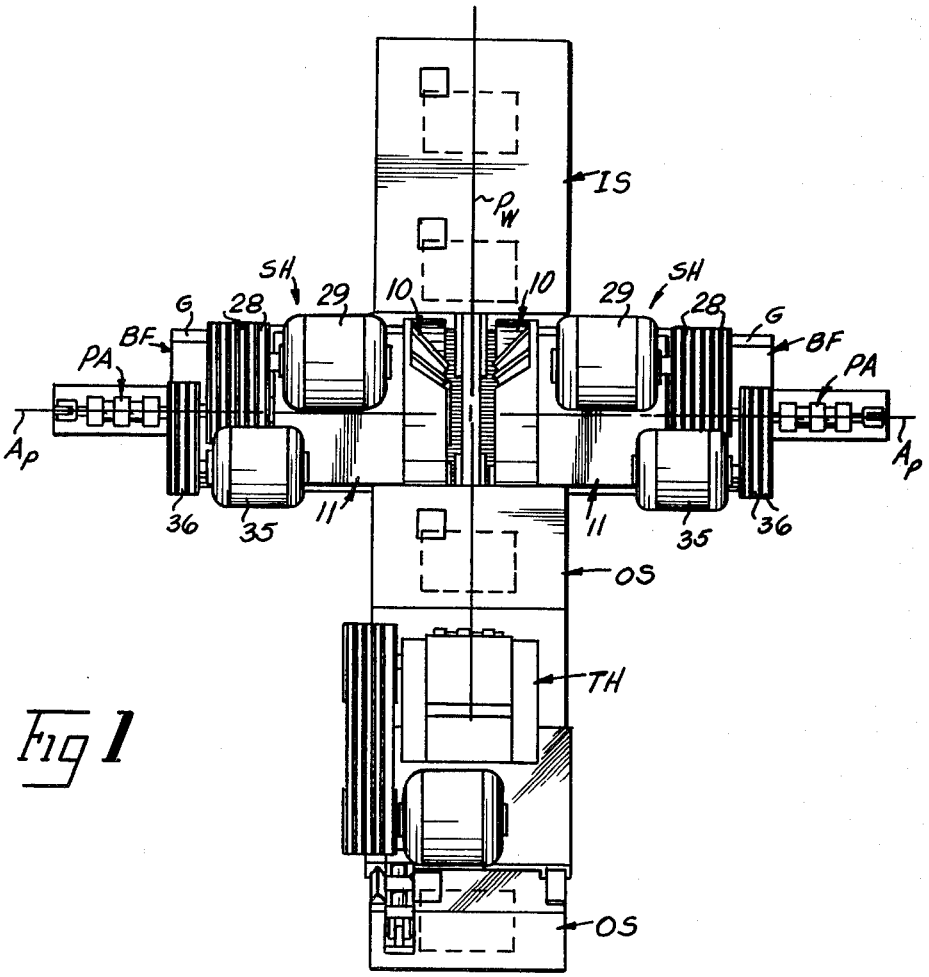
Fig 1
Fig 2
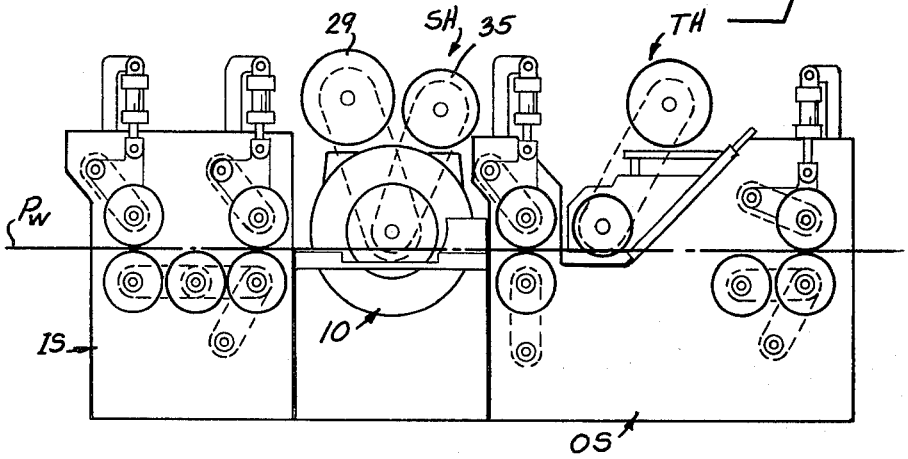

DUAL ROTATION CHIPPING HEAD

FIELD OF THE INVENTION

This invention relates generally to wood chipping apparatus and more particularly to wood chipping apparatus for forming planar faces on the wood.

DESCRIPTION OF THE PRIOR ART

Wood chipping apparatus that remove the bark and rough outer surface of a log or sawn wood slabs are well known. Such apparatus has rotating chipper knives that chip the removed wood in processable chips. Because the chipper knives tend to tear out any knots or other grain irregularities in the wood, the chipped surface is typically not smooth enough for use without subsequent processing.

To combat this problem, prior art chippers have mounted circular saw blades directly on the face of the chipping head for rotation therewith. Thus, the saw, rather than the chipping knives, makes the facing cut on the wood to give a better finish. Examples of such chippers are illustrated in U.S. Pat. Nos. 3,780,778; 3,880,215 and 4,266,584. One of the problems associated with such arrangements is that wood fibers and silvers tend to wedge between the cutters and saw blades. Another problem is that it is difficult to design the chipping knives and saw blade such that the best cutting characteristics of each are achieved at the same rotational speed. Further, this construction is limited to the saw blade diameter being larger than the cutting diameter of the cutter knives at the saw blade.

SUMMARY OF THE INVENTION

These and other problems and disadvantages associated with the prior art are overcome by the invention disclosed herein by providing a chipping head with the chipping knives mounted thereon and in which is mounted a separate cutter head rotatable independently of the chipping head with the facing cutters mounted on the cutter head. Since there is relative motion between the chipping head and cutting head, the wedging of wood fibers and slivers therebetween is eliminated. Further, the chipping head can be rotated at the required rotational speed for good chip formation by the chipping knives while the cutter head can be rotated at a different rotational speed to achieve a smooth face on the wood being processed The apparatus of the invention includes generally a conical chipping head mounted on a tubular chipping arbor member. The chipping arbor member is rotatably journalled in a support about a primary axis of rotation so that the wood to be processed is passed by the chipping head. The chipping head mounts a plurality of chipping knives thereon so that the knives chip away the portions of the wood to be removed. The chipping head defines a recess in that end facing the wood being processed in which is positioned a cutter head. The cutter head is mounted on a cutter arbor member rotatably journalled in the tubular chipping arbor member so that the cutter head and its arbor member is free to rotate about the primary axis of rotation independently of the chipping head. The cutter head mounts a plurality of facing cutters thereon which face the wood being processed. The chipping and cutter heads may be independently driven so that the optimal cutting speed can be selected for each.

In one embodiment of the invention, the facing cutters are mounted on the cutter head along a circular path smaller in diameter than the chipping knives so that, after the chipping knives have chipped away the wood being processed, the facing cutters on the cutting head face the wood. In another embodiment of the invention, the facing cutters are arranged along a circular path larger in diameter than the minor chipping knive diameter so that the wood is first severed by the facing cutters to form the face and the excess wood is then chipped away for the chipping knives. In this embodiment, the cutter head is also provided with a set of secondary cutters along a circular path smaller than the diameter of the chipping knives and located between the facing cutters and the chipping head to comminute any wood fibers or slivers that pass between the chipping and cutting heads.

These and other features and advantages of the invention disclosed herein will become more apparent upon consideration of the following specification and accompanying drawings wherein like characters of reference designate corresponding parts throughout the several views and in which:

BRIEF DESCRIPTION OF THE DRAWINGS

FIG. 1 is a top view illustrating a machine embodying the invention;

FIG. 2 is a schematic cross-section thereof;

Figure 3:
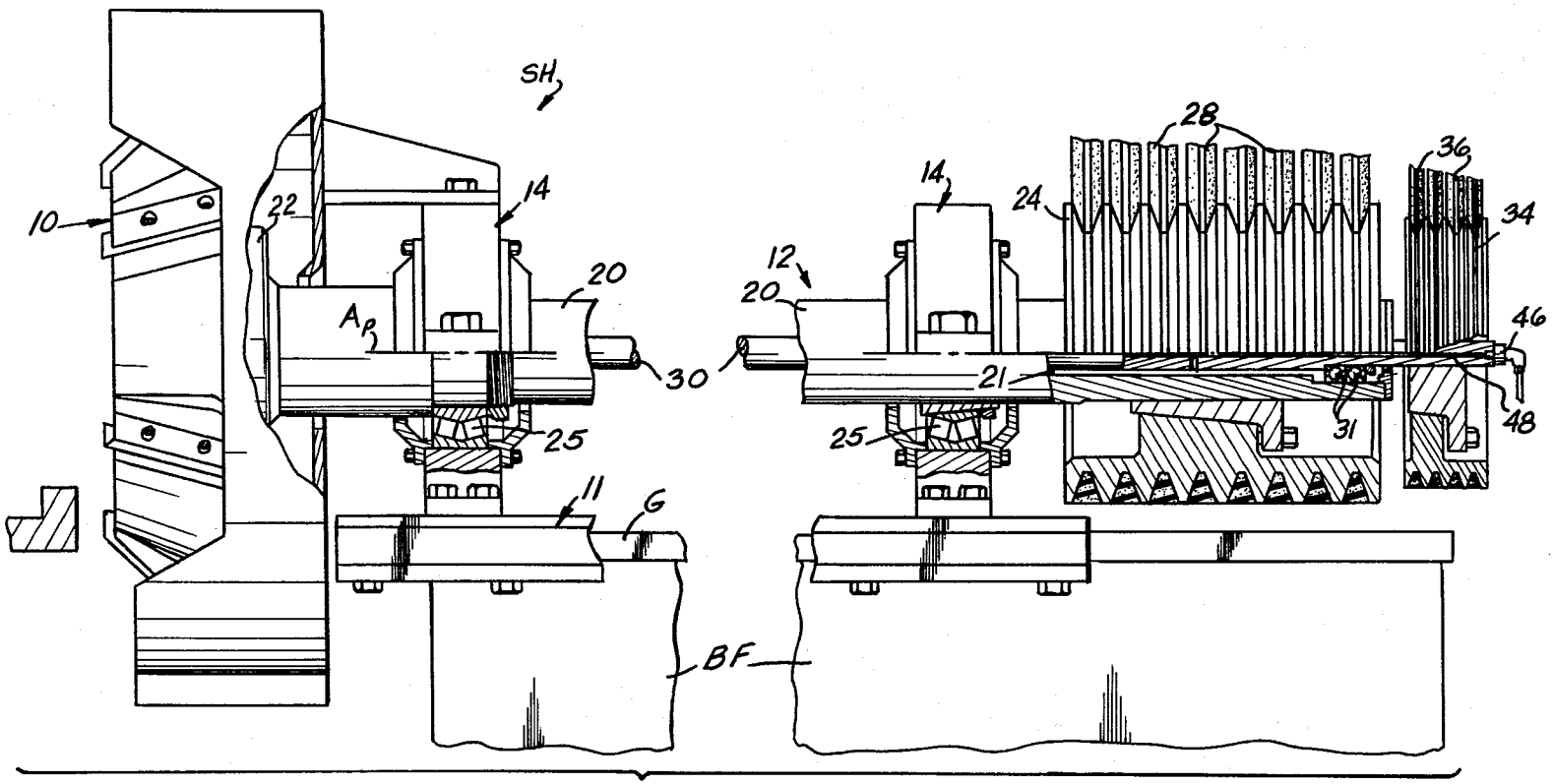
FIG. 3 is a partial side view of the invention illustrating the mounting thereof.

These figures and the following detailed description disclose specific embodiments of the invention; however, it is to be understood that the inventive concept is not limited thereto since it can be incorporated in other forms.

DETAILED DESCRIPTION OF ILLUSTRATIVE EMBODIMENTS

Referring to the drawings, it will be seen that the apparatus of the invention is incorporated in wood chipping apparatus adapted to chip away the rough exterior surface of a log to form a cant or the wane from the edges of sawn slabs to form lumber. Such apparatus typically includes an infeed section IS which feeds the workpieces between a pair of opposed side head sections SH that chip away opposite sides of the workpiece and an outfeed section OS which moves the workpiece out of the chipping apparatus. Some chipping apparatus also includes a top head section TH as seen in FIG. 1 and may include a bottom head section depending on the number of sides of the workpiece which is to be chipped. Typically, the invention is incorporated in the side head sections SH; however, the inventive concept may be applied to the other sections. The side head sections SH are typically slidably mounted on a base frame BF so that they are movable toward and away from the path of movement $P_W$ of the workpiece along an adjustment path normal to the workpiece path of movement. Positioner assemblies PA are provided for incrementally moving each side head section SH along its adjustment path. Typically, the side head sections have the same construction.

As seen in FIGS. 1–3, each side head section SH includes a head assembly 10 rotatably journalled on the side head base 11 about an axis $A_P$ normal to the path of movement $P_W$ of the workpiece through the chipping apparatus. The base 11 is slidably mounted on the guides G on the machine base frame BF. The head assembly 10 is mounted on an arbor assembly 12 which is in turn rotatably journalled about axis $A_P$ in a pair of spaced apart bearing blocks 14 on the base 11. For sake of convenience, those portions of the various components closest to the workpieces being processed will be referred to as the inboard portions while those portions farthest away from the workpiece will be referred to as the outboard portions.

The arbor assembly 12 includes a tubular chipping arbor 20 defining a central passage 21 therethrough. The inboard end of the arbor 20 is provided with an outwardly extending chipping head mounting flange 22 while the other end of the arbor 20 is adapted to mount a belt sheave 24 thereon through which the arbor 20 can be driven. The arbor 20 is rotatably mounted in the bearings 25 in the bearing blocks 14 and is provided with appropriate keepers to keep the arbor 20 axially fixed with respect to the bearing blocks. Belts 28 connect the sheave 24 to the chipping drive motor 29 seen in FIG. 1 so that the arbor 20 is driven thereby.

The arbor assembly 12 also includes a facing arbor 30 having an outside diameter such that arbor 30 is received in clearance through the passage 21 in the chipping arbor 20. The arbor 30 is longer than arbor 20 so that it projects from opposite ends of the arbor 20. A bearing 31 is mounted between the outboard end of the arbor 20 mounting belt sheave 24 and the arbor 30 while a bearing 32 rotatably mounts the inboard end of the arbor 30 in the head assembly 10 as will become more apparent so that arbor 30 is free to rotate with respect to the tubular arbor 20. The outboard end of the arbor 30 projecting out past the belt sheave 24 mounts a belt sheave 34 thereon drivingly connected to the facing motor 35 seen in FIG. 1 via belts 36 so that arbor 30 is driven independently of the arbor 20. The inboard end of the arbor 30 projecting past the mounting flange 22 is provided with a bearing mounting section 38. The mounting section 38 includes an abutment 39 adjacent a smaller diameter cylindrical portion 40 so that the inner race of bearing 32 fits over portion 40 and abuts the abutment 39. The section 38 is threaded adjacent the cylindrical portion 40 to be threadedly engaged by a keeper 41 to fix the bearing 32 axially of the arbor 30. A cylindrical cutter head mounting section 42 is provided on the arbor 30 adjacent the threaded end of portion 40 with a reduced diameter so that an abutment shoulder 44 is formed between the section 42 and portion 40. That end of the section 42 opposite shoulder 44 is threaded to receive a head mounting nut 45 thereon as will become more apparent.

The outboard end of the arbor 30 is also provided with a rotary joint 46 connected to an appropriate pressurized lubricant supply (not shown). Internal passages 48 in the arbor 30 connect joint 46 to the space between the arbors 20 and 30 between bearings 31 and 32 so that lubricant under pressure is supplied to both bearings.

The head assembly 10 includes a chipper head 50 and a facing head 51. The chipper head 50 is bolted to the flange 22 on the chipper arbor 20 while the facing head 51 is mounted on the cutter head mounting section 42 of the facing arbor 30.

While different configurations may be used for the chipper head 50, it is illustrated as a frusto-conical body 55 defining a plurality of knife mounting cutouts 56 therein in each of which is mounted a chipping knife 58 on its holder 59. A chip removal cutout 60 is also provided adjacent each knife 58 so that the wood chips can exit therethrough. The chip cutting edge 61 on each knife 58 angles inwardly toward the axis $A_P$ from its outboard end toward its inboard end closest to the path of movement $P_W$ of the workpiece. The chip cutting edge 61 is also skewed with respect to the axis $A_P$ as is common in the wood chipping industry. Thus, as the wood workpiece is moved thereby, the knives 58 will chip away those portions of the workpiece coming in contact with the knives. Typically, these chipping knives 58 also have an inboard cutting edge 63 that cuts along an end plane $P_E$ normal to the axis $A_P$.

Figure 4:
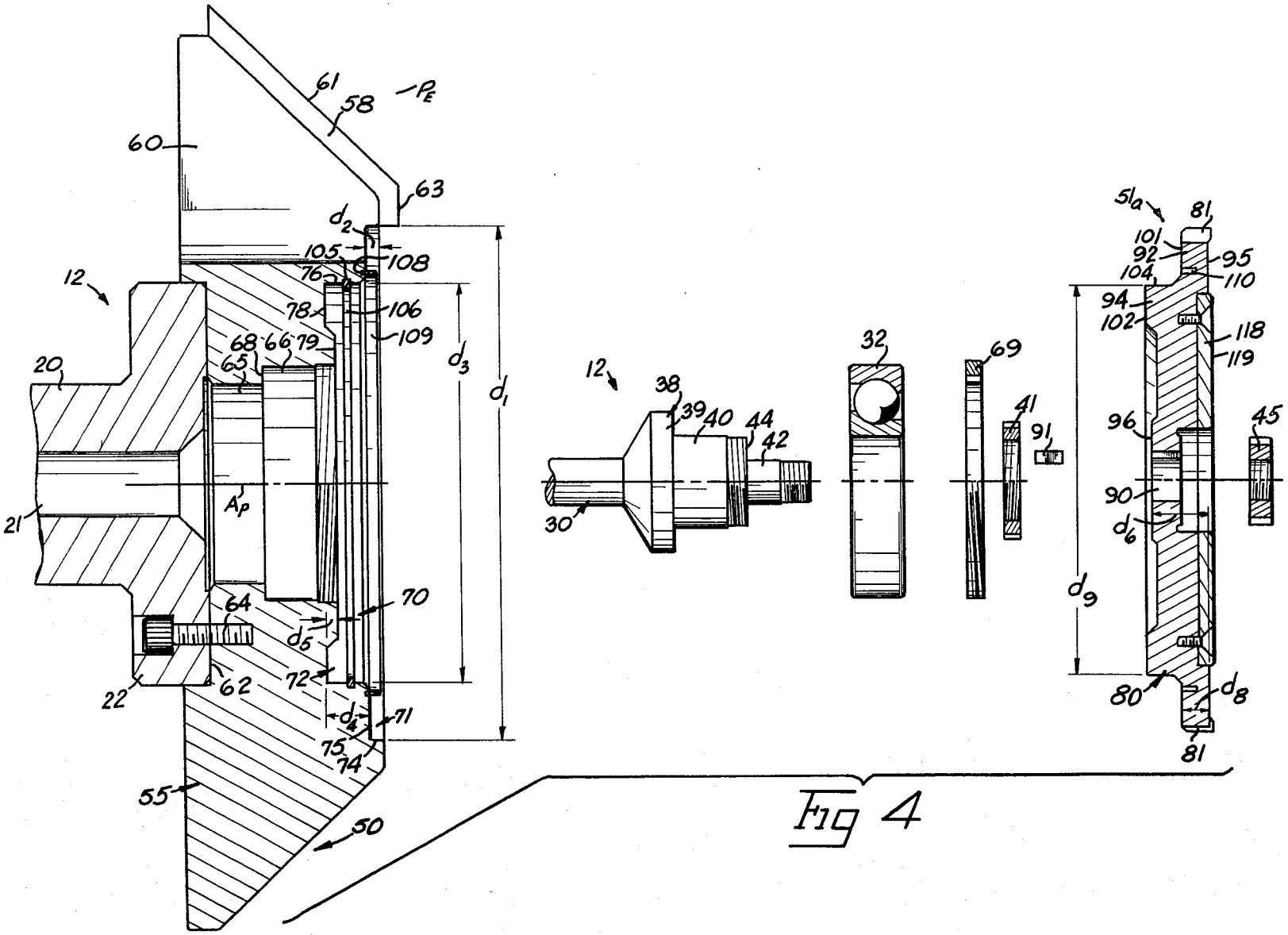
FIG. 4 is an exploded longitudinal cross-sectional view of the head assembly.

The chipper head body 55 as best seen in FIG. 4 is provided with a recess 62 in its outboard end adapted to receive the mounting flange 22 on arbor 20 therein. Fasteners 64 affix body 55 to flange 22 so that the central axis of the body 55 coincides with the rotational axis $A_P$ of arbor 20. The body 55 is also provided with a central passage 65 therethrough sufficiently large to clear the arbor 30. A bearing recess 66 is provided in body 55 to receive the bearing 32 therein. The shoulder 68 formed between recess 66 and passage 65 provides a fixed abutment surface against which the bearing 32 is held by a bearing lock nut 69 threadedly engaging the body 55 around recess 66 in opposition to shoulder 68. This serves to fix the bearing 32 axially of the chipping arbor 20 so that the facing arbor 30 is axially fixed relative to the chipper head 50 as will become more apparent.

The inboard end of the chipper head body 55 defines a counterrecess 70 therein opening onto the bearing recess 66 and central passage 65. The facing head 51 is mounted on the arbor 30 within the counterrecess 70 as will become more apparent. The counterrecess 70 includes a first cylindrical portion 71 opening onto the inboard end of body 55 with a diameter larger than the circle subscribed by the inside ends of the chip removal cutouts 60. A second cylindrical portion 72 extends from the outboard end of the first cylindrical portion 71 to the bearing recess 66 and has a diameter smaller than that of the circle subscribed by the inside ends of the chip removal cutouts 60. Thus, counterrecess 70 is defined by a major cylindrical surface 74 concentric of axis $A_P$ with diameter $d_1$ extending from the inboard end of body 55 outwardly for a depth $d_2$ to a major annular face 75 oriented normal to axis $A_P$ and extending inwardly to a minor cylindrical surface 76 concentric of axis $A_P$ with diameter $d_3$ extending from face 75 outwardly for a depth $d_4$ to a minor annular face 78 oriented normal to axis $A_P$. The face 78 extends inwardly to a stepped annular face 79 normal to axis $A_P$ and shifted toward the inboard end of body 55 the distance $d_5$ from face 78.

The facing head 51 is illustrated in two configurations designated respectively $51_a$ and $51_b$. The head $51_a$ has a cutting diameter smaller than the minimum inboard cutting diameter of the knives 58 on the chipper head 50 while the head $51_b$ has a cutting diameter larger than the inboard chipping diameter of the knives 58 on chipper head 50. Both configurations of the facing head 51 make a facing cut just inboard of the cut along the end plane $P_E$ made by the knives 58 on chipper head 50.

Figure 7:
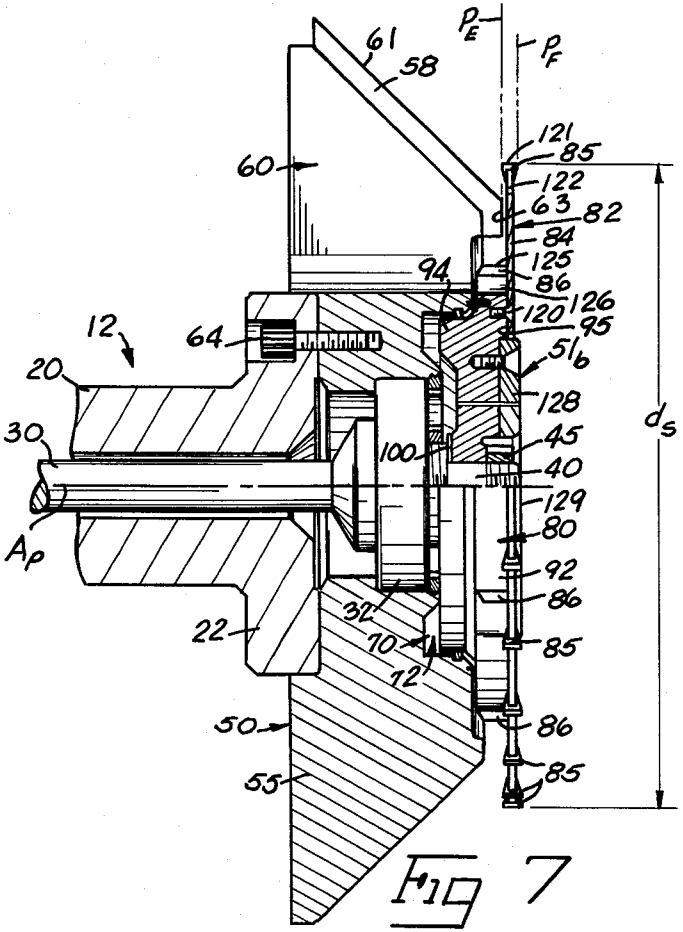
FIG. 7 is an assembled cross-sectional view of a second embodiment of the head assembly.
Figure 5:
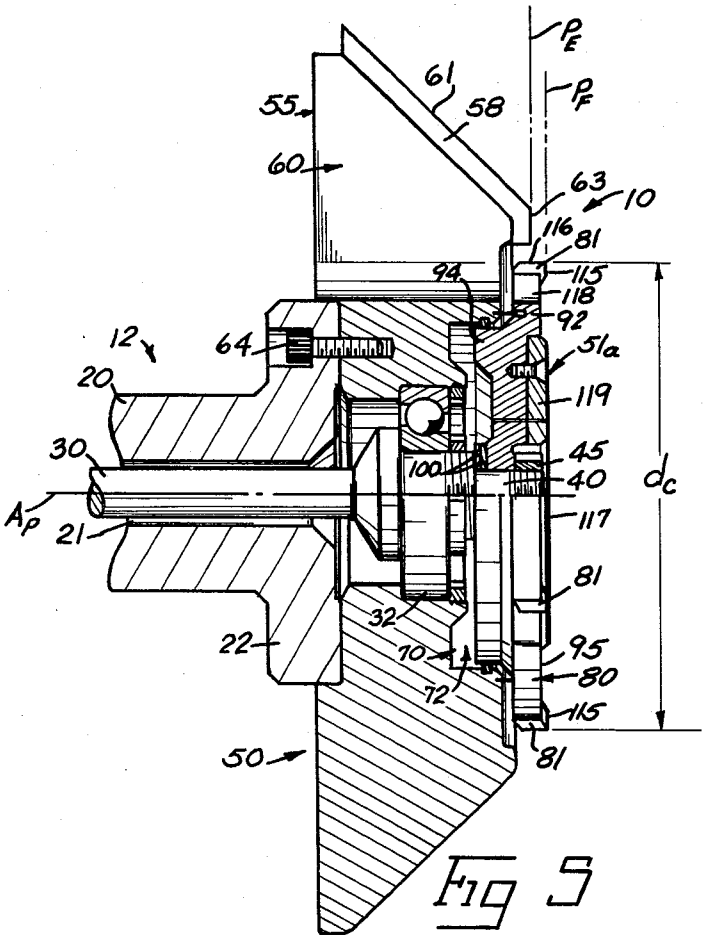
FIG. 5 is an assembled cross-sectional view of a first embodiment of the head assembly.
Figure 6:
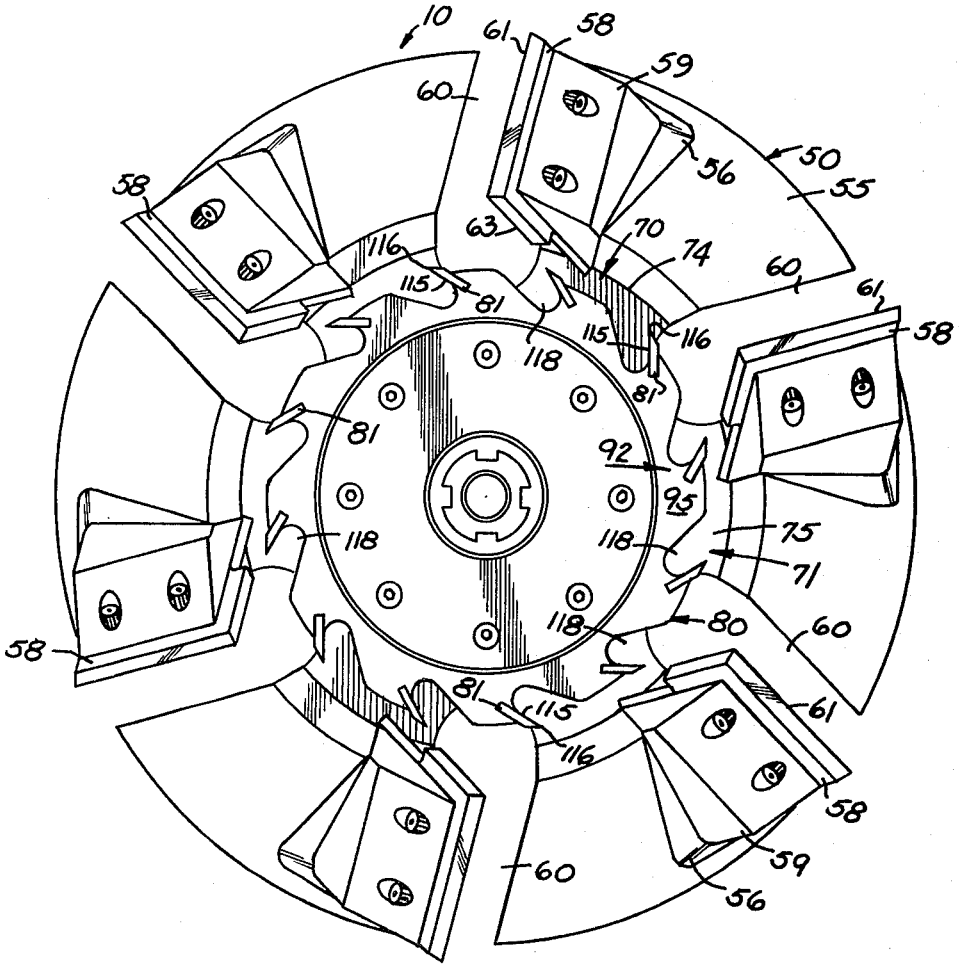
FIG. 6 is a face view of the head assembly of FIG. 5.
Figure 8:
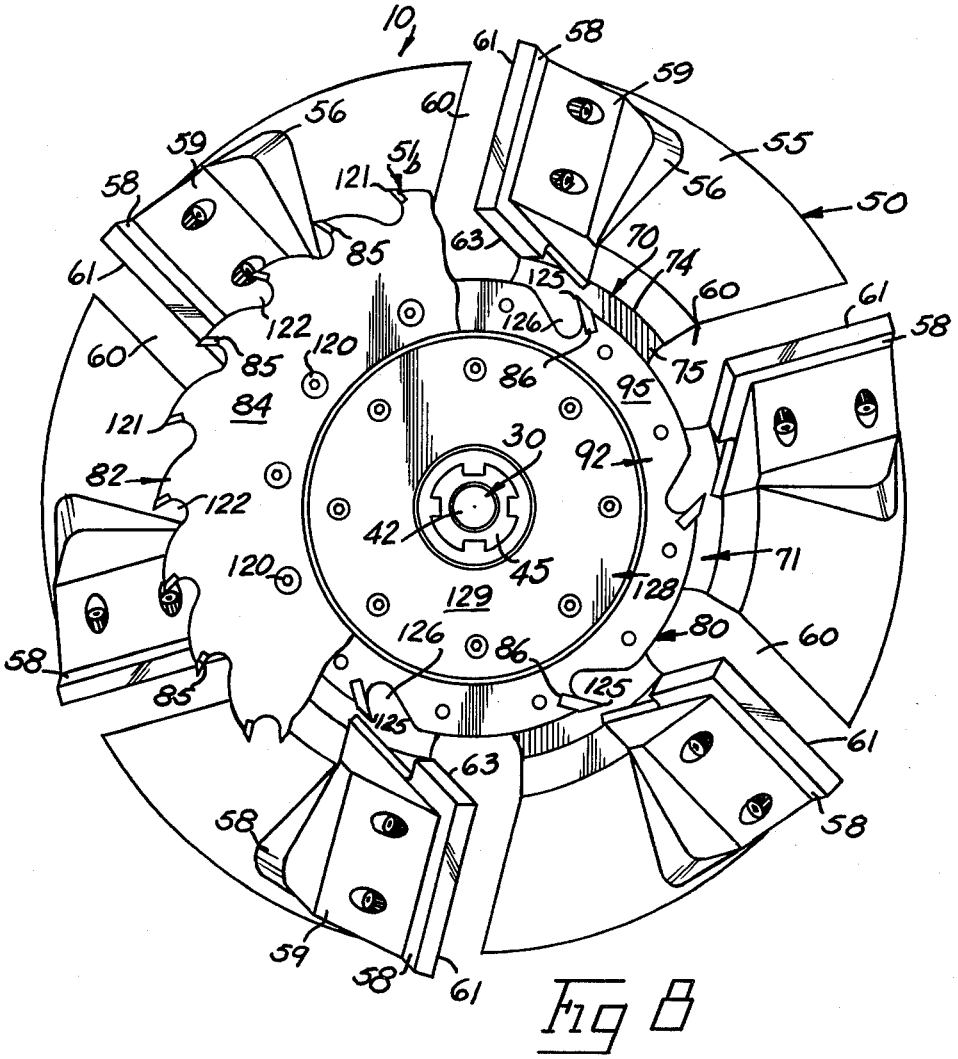
FIG. 8 is a face view of the head assembly of FIG. 7.

Both configurations of the facing head 51 use a common head body 80. The head $51_a$ as seen in FIGS. 5 and 6 includes a set of facing cutters 81 mounted along the periphery of the body 80 so that the cutters subtend a diameter smaller than the minimum inboard cutting diameter of the chipping knives 58. The cutters 81 project inwardly of the end plane $P_E$ of the chipper knives 58 to face the wood workpiece after it has been chipped by the chipper knives 58. The head $51_b$ as seen in FIGS. 7 and 8 includes a cutter assembly 82 mounted on the body 80. The cutter assembly 82 includes a thin annular plate 84 mounted on body 80 and mounting a set of facing cutters 85 thereon so that the cutters subtend a diameter larger than the inboard chipping diameter of the chipping knives 58. The head $51_b$ also mounts a set of backup cutters 86 along the periphery of the body 80 just outboard of the plate 84. These backup cutters 86 subtend a diameter smaller than the minimum inboard cutting diameter of the chipping knives 58 and serve to chip any slivers or the like that pass between the facing cutters 85 and chipping knives 58. The entire cutter assembly 82 lies inboard of the end plane $P_E$ of the chipper knives 58 to make a facing cut on the workpiece just prior to the removed wood being chipped by the inboard end of the chipping knives 58.

As seen in FIGS. 6 and 8, the head body 80 is adapted to be positioned in the counterrecess 70 in the end of the chipper head body 55 and to be mounted on the head mounting section 42 of the facing arbor 30 as will become more apparent. The body 80 defines a central passage 90 therethrough sized to be received on the section 42 of arbor 30. The inboard end of body 80 has a counterbore about passage 90 so that when the locating surface 96 on the outboard end of the body 80 engages the shoulder 44 on arbor 30, the head mounting nut 45 can be screwed onto the arbor 30 to axially affix the head body 80 to the arbor 30. A key 91 between body 80 and arbor 30 rotationally affixes body 80 to arbor 30.

The body 80 as best seen in FIG. 4 has an inboard flange 92 that mounts the cutters 81 or 86 and an outboard projection 94 that extends into the smaller portion 72 of the counterrecess 70 for sealing purposes as will become more apparent. The flange 92 has an inboard face 95 oriented normal to axis $A_P$ and spaced inboard of the locating surface 96 a distance $d_6$ such that, when the surface 96 abuts shoulder 44 on arbor 30, the inboard face 95 will be located substantially flush with the end plane $P_E$ defined by chipper knives 58. The inboard face 95 can be shifted inwardly by using different thicknesses of shims 100 as seen in FIGS. 6 and 8 to adjust the facing cutting planes as will become more apparent. The outboard face 101 of the flange 92 is spaced outboard of the face 95 a distance $d_8$ and oriented normal to axis $A_P$ so that, when body 80 is located at its outboardmost position, the face 101 will just clear the major annular face 75 in counterrecess 70. The projection 94 has an annular outboard face 102 thereon facing the minor annular face 78 in counterrecess 70 so that, when the body 80 is in its outboardmost position, the face 102 on projection 94 will just clear the face 78 in counterrecess 70. The projection 94 defines a cylindrical peripheral surface 104 thereon with an outside diameter $d_9$ slightly less than the diameter $d_3$ of the surface 76 in the counterrecess 70 to just provide a running clearance between the surfaces 104 and 76. As will become more apparent, the axial lengths of the surfaces 76 and 104 are sufficient to remain overlapped through all stages of adjustment to permit these surfaces to be sealed to each other.

The body 55 defines an annular groove 105 therein that opens onto the surface 76 in the counterrecess 70. An appropriate oil seal ring 106 is mounted therein and projects into the counterrecess 70 to form a seal with the surface 104 on the facing head body 80. It will be appreciated that the seal 106 is located axially of the surface 76 so that a seal will be maintained between the bodies 55 and 80 over the full range of axial adjustment of the facing head 51.

The body 55 also defines an annular groove 108 therein that opens onto the face 75 of counterrecess 70. The groove 108 mounts a protector ring 109 therein that projects inwardly from the face 75 toward the flange 92 on the facing head 51. The flange 92 defines a clearance groove 110 therein that opens onto the outboard face 101 thereof and is located in registration with the ring 109 so that the ring 109 projects thereinto in close tolerance clearance therewith. The depth of the clearance groove 110 and the distance the protector ring 109 projects from the face 75 on body 55 are such that the projecting end of the ring 109 remains in groove 110 over the facing head adjustment range without bottoming out in groove 110.

The protector ring 109 serves to prevent wood fibers and other debris from passing between the heads 50 and 51 and is usually made out of steel. The ring 106 serves primarily as a low pressure oil seal and is typically a plastic material commonly used in seals.

In the head $51_a$ as seen in FIGS. 5 and 6, the facing cutters 81 are mounted on the inboard flange 92 of the facing body 80 so that each of the cutters 81 projects inboard of the inboard fce 95 thereon as well as outwardly of the peripheral edge of flange 92. Each of the cutters 81 is provided with a sharpened facing edge 115 along its inboard end oriented so that the cut made thereby is oriented normal to the rotation axis $A_p$. Each cutter 81 is also provided with a sharpened chipping edge 116 oriented normal to facing edge 115 and extending outboard from edge 115 along the radial outer side of cutter 81. Thus, the facing edges 115 on cutters 81 make a facing cut on the workpiece along a facing plane $P_F$ located inboard of the end plane $P_E$ on the chipping knives 58 while the chipping edges 116 on cutters 81 chip away the wood lying between the facing plane $P_F$ and the end plane $P_E$. The cutters 81 are angled appropriately with respect to the head radius to give proper rake angle for cutting. Typically, a rake angle of about forty-five degrees is used. The body of each cutter 81 may also be skewed with respect to the rotational axis $A_P$ as viewed along the head radius with the inboard end of cutter 81 leading. This serves to deflect the wood chips made by cutters 81 away from the face of the workpiece formed by cutters 81. An appropriate chip clearance cutout 118 is formed in the flange 92 on the leading side of each of the cutters 81 to permit the chips formed by cutters 81 to exit therethrough. The length of each of the chipping edges 116 on the cutters 81 is selected so that the edges 116 project outboard of the end plane $P_E$ of knives 58 when the head $51_a$ is set at its maximum projection inboard of the end plane $P_E$ to insure that all of the wood lying between planes $P_F$ and $P_E$ will be chipped over the full range of adjustment of head $51_a$ as will become more apparent.

The cutting diameter $d_c$ subtended by the chipping edges 116 on cutters 81 is smaller than the minimum inboard cutting diameter of chipping knives 58 and the larger diameter portion 71 of counterrecess 70 to provide running clearance for facing head $\mathbf{51}_a$. At the same time, the diameter subtended by the inner ends of the chip clearance cutouts 188 is at least as great as the diameter subtended by the inner ends of the chip removal cutouts 60 in the chipper head body 55 so that the wood chips formed by the facing head $\mathbf{51}_a$ and discharged out of the cutouts 118 can pass out through the cutouts 60 to clear both heads 50 and $\mathbf{51}_a$.

As the chipping knives 58 chip away the workpiece, the roughness of the surface formed by the chipping knives at he end plane $P_E$ varies depending on the species of wood being processed. This roughness depends on the amount of the wood fiber tear-out experienced as the workpiece is being chipped. The axial adjustment of the facing head $\mathbf{51}_a$ along the axis $A_P$ permits the cutters 81 thereon to chip away the wood from the workpiece to the depth of the tear-out experienced by the chipping action of the knives 58. This axial adjustment is provided by the shims 100 mentioned hereinabove. It will be appreciated that, without the use of any shims 100, the head $\mathbf{51}_a$ will directly abut the shoulder 44 on the facing arbor 30 so that the inboard face 95 will be located substantially flush with the end cutting plane $P_E$ of the chipping knives 58. It will further be appreciated that the facing edge 115 is displaced inboard of the face 95 a prescribed distance to permit the cutter 81 to form the facing cut. Thus, without any shims 100, the depth of wood removed to face the workpiece is the distance the cutter 81 projects inboard of face 95 on the head $\mathbf{51}_a$. As the shims 100 are added, the facing plane $P_F$ can be shifted further and further inboard of the end cutting plane $P_E$ of the chipping knives 58. Thus, when the chipping head $\mathbf{51}_a$ is mounted, the appropriate number and thicknesses of shims 100 are selected to locate the facing plane $P_F$ sufficiently from the end plane $P_E$ to remove any surface roughness associated with the tear-out as the workpiece is chipped. The amount of adjustment, of course, is limited by the length of the chipping edge 116. Typically, an adjustment of one-fourth to one-half inch is sufficient to handle most species of wood.

An annular face plate 119 is mounted on the inboard end of the body 80 to provide lateral support for the workpiece after it has been chipped and faced. The face plate 188 is sized to provide an inboard face 177 coplanar with the facing plane $P_F$.

The head $\mathbf{51}_b$ as best seen in FIGS. 7 and 8 is used primarily with those species of wood where the chipping tear-out is so deep that it cannot be readily handled by the facing head $\mathbf{51}_a$. In the facing head $\mathbf{51}_b$, the annular mounting plate 84 of cutter assembly 82 is affixed to the inboard face 95 on the facing head body 80 with appropriate fasteners 120 so that it is oriented normal to the rotational axis $A_P$ and projects outwardly of the flange 92 on the body 80. The facing cutters 85 are mounted on plate 84 so that the cutting edges 121 thereon subtend a circle concentric of axis $A_P$ with a cutting diameter $d_s$ larger than the inboard chipping diameter of knives 58 so that the cutters 85 are located outwardly past the inboard ends of the chipping edges 61 on knives 58. The cutting edges 121 on cutters 85 have a transverse width greater than the thickness of the mounting plate 84 with the cutters 85 transversely centered across plate 84 to provide running clearance for the plate 84 in the kerf made by cutters 85. The cutting diameter $d_s$ of the cutters 85 is larger than the chipping diameter at the inboard ends of the chipping edges 61 by an amount such that the cutters 85 project outwardly past the inboard ends of the chipping edges 61 a distance about equal to the chip load of the chipping knives 58. Usually this distance is about 0.75–1.25 inch. Appropriate chip clearance cutouts 122 are provided in the mounting plate 84 on the leading side of the cutters 85 to permit the chips formed by the cutters 85 to clear the workpiece. The cutters 85 are oriented at the proper rake angle for cutting and are typically about forty-five degrees. The head $\mathbf{51}_b$ is axially located with respect to the head 50 so that the inboard ends of the chipping knives 58 are in running clearance with the mounting plate 84. This maximizes the amount of wood lying outboard of the cutters 85 that will be chipped by the chipping knives 58.

The backup cutters 86 are mounted on the inboard flange 92 on body 80 similarly to the cutters 81 on head $\mathbf{51}_a$. The cutters 86 abut the outboard face of plate 84 and project outboard thereof. Cutters 86 each have a chipping edge 125 along its radial outer side and a chip clearance cutout 126 is provided in flange 92 on the leading side of cutters 86. Any wood slivers or the like not chipped by knives 58 and passing inwardly thereof between the mounting plate 84 and the inboard end of chipping head body 55 will be chipped by the cutters 86 and discharged out through the cutouts 126 in head $\mathbf{51}_b$ and the cutouts 60 in head 50. This prevents any buildup of wood fibers between the heads $\mathbf{51}_b$ and 50 and thus eliminates binding.

An annular face plate 128 is mounted on the inboard end of the body 80 to laterally support the workpiece after it has been faced and chipped. The face plate 128 defines an inboard face 129 thereon coplanar with the facing plane $P_F$.

While the chipping head 50 is illustrated as a conical head with each of the knives 58 extending across the full cutting width of head 50 at an angle to the rotational axis, it will be appreciated that other chipping head configurations can be used. For instance, the chipping head can have several different knife sets arranged in separate rows of different diameters. The different diameter rows are shifted axially from each other with the smallest diameter row at the inboard end of the head and the largest diameter row at the outboard end of the head. The function and arrangement of the facing head 51 would remain substantially as described.

The use of the separate chipping and facing heads permits the desired size chip to be made while the desired surface smoothness can be made on the face of the workpiece. For instance, processing equipment for the wood chips typically requires that a major portion of the wood chips have lengths in the range of $\frac{3}{4}$–$1\frac{1}{4}$ inch thus requiring a chip load of these dimensions for the chipping head 50. At the same time, an acceptable surface finish on the processed face of the workpiece typically requires a chip load of about 0.050 inch or less. Thus, if both the chipping head 50 and facing head 51 are operated at the same rotational speed, it is virtually impossible to have enough cutters on the facing head 51 to have a small enough chip load. As a result of using separate heads, the facing head 51 can be operated at a sufficiently higher rotational speed than the chipping head 50 so that the number of cutters on the facing head 51 can be reduced to a feasible number.

The number of chipping knives 58 used on the chipping head 50 is dependent on the feed speed of the workpiece along the processing path $P_W$ and the rotational speed of head 50 to produce the desired size chip. On the other hand, it is desirable to keep the rotational speed of the chipping head 50 in the 700–1500 rpm rage to achieve good chip discharge from the head 50. As an example, a chipping head 50 with six knives 58 and rotating at about 1330 rpm produces a chip load of about ¾ inch when the feed speed along path $P_W$ is about 500 linear ft/min.

Similarly, the number of cutters 81 or 85 on the facing head 51 is dependent on the feed speed and the rotational speed of head 51 to produce the desired chip load. For instance, at a feed speed of 500 ft/min. and a chip load of about 0.050 inch, 38 cutters on head 51 rotating at 3158 rpm can be used. Likewise, 45 cutters on head 51 rotating at about 2960 rpm has a chip load of about 0.045 at a feed speed of 500 ft/min. With 60 cutters on head 51 rotating at about 3334 rpm, a chip load of about 0.030 inch is achieved when the feed speed is about 500 ft/min. When feasible, a chip load of about 0.030 is preferred. In any event, the cutting diameter of head 51 sets the practical number of cutters that can be installed thereon. Also, it is desirable to keep the rotational speed of head 51 above about 1700 rpm to insure that the chips formed thereby will clear the head.

The easiest way to achieve the different rotational speeds for the heads 50 and 51 is to use the two different motors 29 and 35 to individually drive heads 50 and 51. It is to be understood, however, that once the relative rotational speeds between the heads 50 and 51 are determined for each machine, a single drive with two outputs may be used or the arbors 20 and 30 may be drivingly interconnected so that a single drive motor can be used.

What is claimed as invention is:

1. A dual rotation chipping head assembly for processing wood workpieces moved thereby including:

a chipping head body having an inboard end past which the workpiece is moved;

a tubular chipping arbor member mounting said chipping head body thereon for rotation therewith about a primary axis of rotation;

a facing head body;

a facing arbor member rotatably mounted in said chipping arbor member coaxially therewith, said facing arbor member mounting said facing head body thereon adjacent the inboard end of said chipping head body for rotation independently of said chipping head body and said chipping arbor member;

a plurality of chipping knife means circumferentially spaced around the periphery of and mounted on said chipping head body for rotation therewith, said knife means defining chipping edges thereon adapted to chip that portion of the wood workpiece moved thereby which lies outboard of an end cutting plane at the inboard end of said chipping head body; and a plurality of cutter means circumferentially spaced around said facing head body for rotation therewith independent of said chipping knife means, said cutter means defining cutting edges thereon just inboard of the end cutting plane of said chipping knife means to form a flat face on the wood workpiece along a facing plane lying inboard of the end cutting plane.

2. The chipping head assembly of claim 1 wherein said cutting edges on said cutter means subtend a circle whose diameter is smaller than the diameter subtended by said chipping edges on said chipping knives at the end cutting plane.

3. The chipping head assembly of claim 1 wherein said cutting edges on said cutter means subtend a circle whose diameter is larger than the diameter subtended by said chipping edges on said chipping knives at the end cutting plane.

4. The chipping head assembly of claim 1 wherein said cutter means includes a first set of cutters defining first cutting edges thereon subtending a circle whose diameter is larger than the diameter subtended by said chipping edges on said chipping knives at the end cutting plane, and a second set of cutters defining said cutting edges thereon subtending a circle whose diameter is smaller than the diameter subtended by said chipping edges on said chipping knives at the end cutting plane, said second set of cutters located outboard of said first set of cutters.

5. The chipping head assembly of claim 1 further including drive means for rotating said chipping arbor member and thus said chipping head body at a first prescribed rotational speed and for rotating said facing arbor member and thus said facing head body at a second prescribed rotational speed.

6. The chipping head assembly of claim 1 wherein said chipping head body defines a counterrecess therein opening onto the inboard end thereof, said facing arbor member mounting said facing head body in said counterrecess for rotation therein.

7. The chipping head assembly of claim 6 wherein said counterrecess includes a larger diameter cylindrical portion opening onto the inboard end of said chipping head body inboard of said chipping edges on said chipping knife means and a smaller diameter cylindrical portion opening into said larger diameter cylindrical portion and extending outboard thereof; wherein said facing head body defines a flange thereon positioned in said larger diameter cylindrical portion and a projection thereon positioned in said smaller diameter cylindrical portion; and further including oil sealing means between said smaller diameter cylindrical portion of said counterrecess and said projection on said facing head body.

8. The chipping head assembly of claim 7 further including protector means between said larger diameter cylindrical portion of said counterrecess and said flange on said facing head body to prevent wood fibers from passing between said chipping and facing head bodies in said counterrecess.

9. The chipping head assembly of claim 1 further including adjustment means for adjustably locating said facing head body axially of said chipping head body so as to adjust the spacing between the end cutting plane of said chipping knife means and the facing plane of said cutter means.

10. A chipping machine for processing wood comprising:

a chipping head rotatably mounted about a primary axis of rotation and having an inboard end past which the wood to be processed is moved, said chipping head including a plurality of chipping knives circumferentially spaced about said primary axis of rotation to chip those portions of the wood in interference with said chipping knives as the wood is moved past the inboard end of said chipping head;

a facing head rotatably mounted adjacent the inboard end of said chipping head and including a plurality facing cutters adapted to cut a flat face on the wood just inboard of said chipping knives; and drive means adapted to rotate said chipping head at a first speed and to rotate said facing head at a second speed so as to effect relative rotation between said facing head and said chipping head.

11. The chipping machine of claim 10 wherein said first speed is selected to cause said chipping knives to generate a prescribed size wood chip and wherein said second speed is selected to cause said facing cutters to generate a prescribed size wood chip smaller than the size of the wood chips generated by said chipping knives to thus generate a smoother face on the wood than the surface formed by said chipping knives.

12. The chipping machine of claim 10 wherein said chipping and facing heads are rotatably mounted about a common axis of rotation.

13. The chipping machine of claim 12 wherein said chipping head defines a recess therein opening onto the inboard end thereof and wherein said facing head is located in said recess so that said facing cutters project out of said recess inboard of said chipping knives.

14. The chipping machine of claim 11 further including feed means for feeding the wood to be processed past said chipping and facing heads.

15. The chipping machine of claim 14 wherein said feed means moves the wood along a prescribed rectilinear processing path and wherein said primary axis of rotation is substantially normal to the processing path.

16. The chipping machine of claim 15 further including positioning means for simultaneously positioning said chipping head and said facing head axially along said primary axis of rotation toward and away from said processing path without varying the positions of said chipping and facing heads relative to each other.

17. A method of chipping wood workpieces comprising the steps of:

moving the wood workpieces along a prescribed feed path;

locating a chipping head with chipping knives thereon adjacent the feed path so as to chip away those portions of the wood lying outboard of a prescribed chipping plane;

locating a facing head with facing cutters thereon coaxially with the chipping head so as to form a face on the wood workpiece lying just inboard of the prescribed chipping plane;

rotating the chipping head at a first prescribed speed to generate prescribed size wood chips; and rotating the facing head at a second prescribed speed to generate a prescribed surface finish on the face of the wood workpiece.

18. The method of claim 17 wherein the facing cutters on the facing head form the face on the wood workpiece after the chipping knives have chipped the workpiece to the chipping plane.

19. The method of claim 17 wherein the facing cutters on the facing head form the face on the wood workpiece just prior to the chipping of the wood workpiece adjacent the chipping plane by the chipping knives.

20. The method of claim 17 wherein the speed of rotation of the chipping head is selected to give a chip load of about 0.75–1.25 inch and wherein the speed of rotation of the facing head is selected to give a chip load of about 0.050 inch or less.

* * * * *